United States Patent [19]

St. Clair

[11] 4,258,514

[45] Mar. 31, 1981

[54] METHOD AND MEANS FOR ANCHORING A DISMOUNTABLE BUILDING

[76] Inventor: Alfred L. St. Clair, 1103 Monroe St., Rochester, Ind. 46975

[21] Appl. No.: 7,719

[22] Filed: Jan. 30, 1979

[51] Int. Cl.[3] ..... E04B 1/32

[52] U.S. Cl. ..... 52/86; 52/105; 52/157; 52/293; 52/742; 135/15 PE

[58] Field of Search ..... 52/2, 63, 105, 742, 52/86, 102, 293, 157; 135/1 R, 15 PE, DIG. 7

[56] References Cited

U.S. PATENT DOCUMENTS

| | | | |
|---|---|---|---|
| 2,120,180 | 6/1938 | Hungrige | 135/15 PE |
| 2,307,215 | 1/1943 | Graef | 52/86 |
| 2,731,055 | 1/1956 | Smith | 52/2 |
| 2,842,806 | 7/1958 | Tomassini | 52/63 |
| 2,849,011 | 8/1958 | Bird | 52/2 |
| 2,953,145 | 9/1960 | Moss | 135/1 R |
| 3,063,104 | 11/1962 | Troxel | 135/1 R |
| 3,233,617 | 2/1966 | Stern | 135/1 R |
| 3,390,491 | 7/1968 | Hayden | 52/2 |
| 3,847,170 | 11/1974 | Anderson | 135/1 R |

FOREIGN PATENT DOCUMENTS

| | | | |
|---|---|---|---|
| 2154813 | 5/1973 | Fed. Rep. of Germany | 52/86 |

*Primary Examiner*—Price C. Faw, Jr.
*Assistant Examiner*—H. E. Raduazo
*Attorney, Agent, or Firm*—Oltsch, Knoblock & Hall

[57] ABSTRACT

A method and means for anchoring a dismountable building by means of earth penetrating members. The building includes frame members which bear upon perimeter plates having ground piercing parts. Elongated ground anchors project through openings in the perimeter plates and are secured to the plates. A flexible sheet spans the ground on which the building is erected and is pierced by the elongated anchors and the ground piercing members of the perimeter plates.

The method of anchoring the building entails the steps of spreading a sheet at a desired location, advancing auger type anchors into the ground through the sheet at points indicated on the sheet, placing on the sheet at positions indicated thereon perimeter plates with openings fitting over projecting portions of the anchors and with spike portions thereof piercing the sheet and penetrating the ground, and securing the perimeter plates to the anchors. The building main frame members are then positioned on and secured to the perimeter plates and sides and roof members are secured to the main frame members.

7 Claims, 3 Drawing Figures

Fig. 1
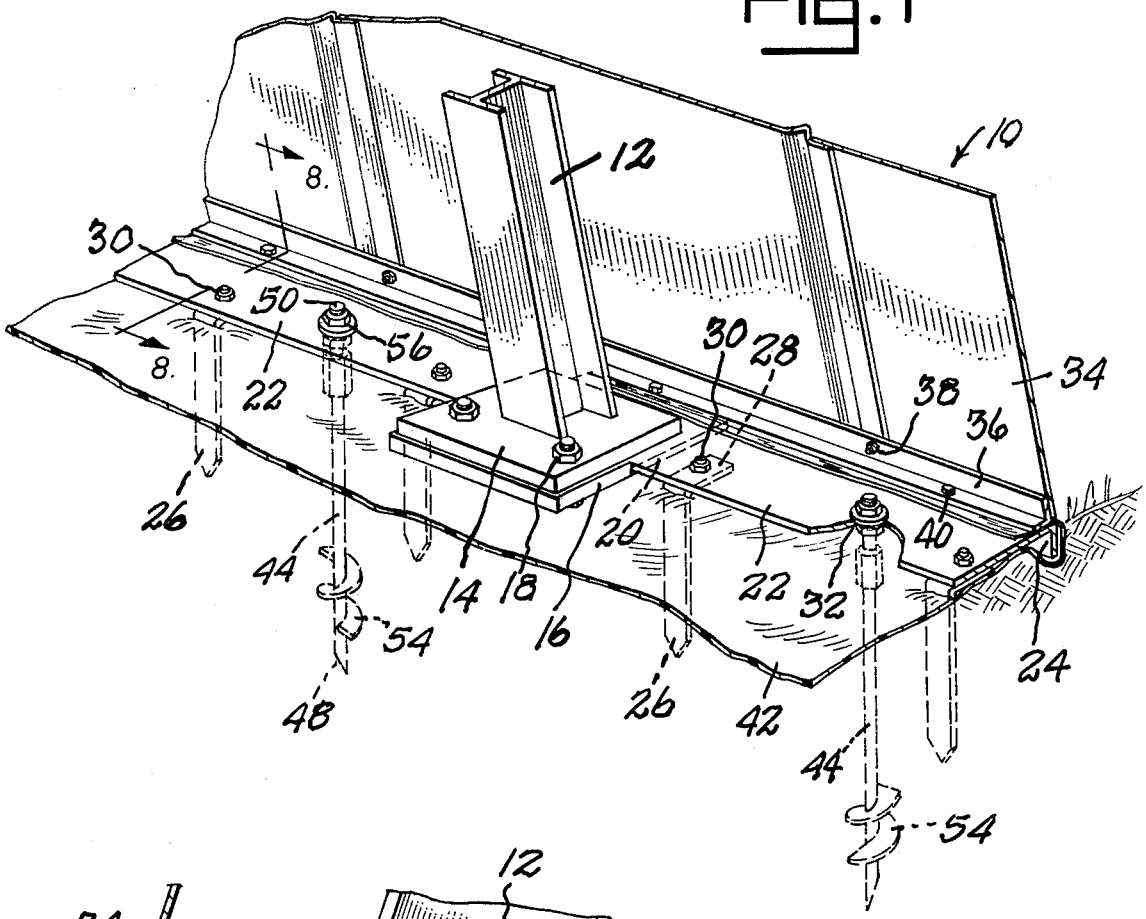
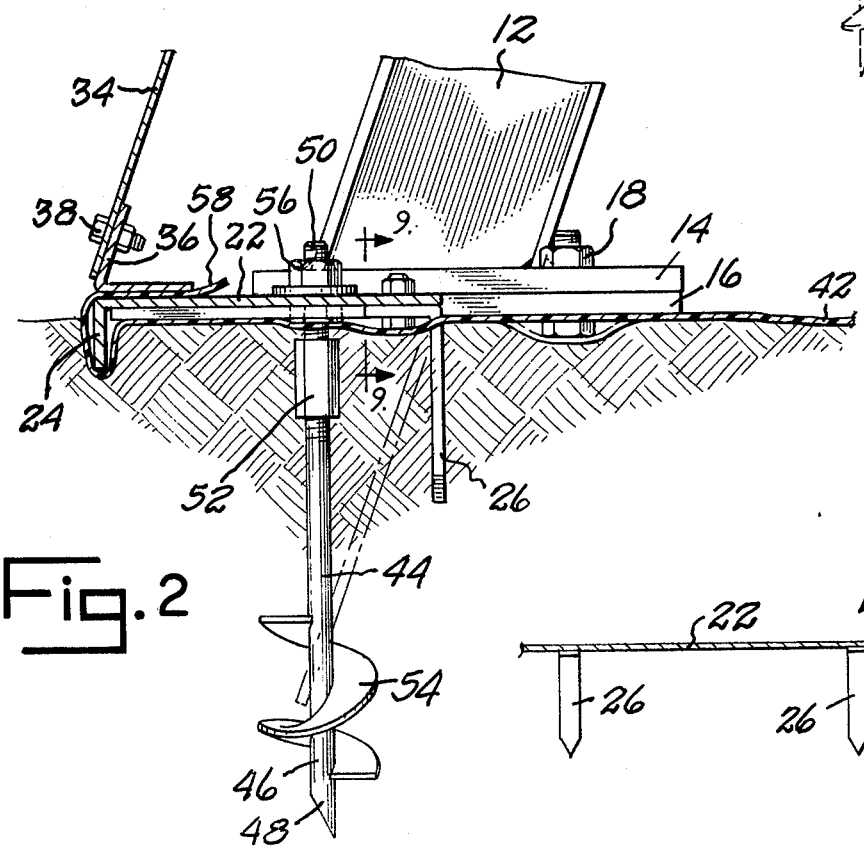
Fig. 2
Fig. 3
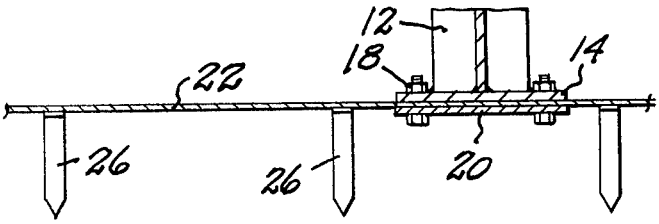

METHOD AND MEANS FOR ANCHORING A DISMOUNTABLE BUILDING

SUMMARY OF THE INVENTION

This invention relates to a method and means for anchoring a dismountable building. It constitutes an improvement upon my copending patent application for metal building anchor filed 1/18/79 Ser. No. 004,381.

The invention relates to building anchors for metal and other buildings which are temporarily located and intended for dismantling and relocation when need thereof at the particular location has ended. Such buildings are commonly formed from kits or units purchased in disassembled or knocked-down condition and intended for assembly and erection by a purchaser at a point of use. Such buildings are commonly erected on a level plot of ground without the benefit of a permanent building foundation such as a poured concrete foundation. The lack of a permanent foundation to which a building can be anchored firmly requires the use of anchoring means which are effective to locate the building firmly and to maintain it in desired location against heavy winds and other adverse weather conditions.

Heretofore the anchorage of such kit-constructed metal buildings and other temporarily located buildings, such as mobile homes, has been accomplished by the use of hold-down cables passed over the top of a building and connected to ground anchors driven into the ground at intervals along each of two opposite sides of the building. Such anchoring means are not fully effective, are unsightly, and require space around the building so as to interfere with movement of building users adjacent to the building, and have other disadvantages.

The construction of the anchor disclosed in my copending application overcomes the disadvantages attendant upon the use of hold-down cables, but requires the use of anchoring means located within the building and interfering with full usuage of the space within the building.

It is the primary object of this invention to provide a building anchor which eliminates the need for hold-down cables passed over the top of a building and which eliminates the need for anchoring means positioned within the building spaced from the walls thereof and interfering with full and free usage of the space within the building.

A further object is to provide a novel, simple anchorage construction which can be installed easily and quickly and entails minimum cost and labor.

A further object is to provide a novel method for anchoring a building which anchor is formed of a plurality of relatively small parts which can be assembled easily and quickly, which are operative to firmly anchor the building against displacement in heavy winds and other adverse weather conditions, and which can be disassembled readily and quickly to facilitate dismantling of a building preparatory to removal thereof for erection and anchorage in a new location.

Other objects will be apparent from the following specification.

BRIEF DESCRIPTION OF THE DRAWINGS

FIG. 1 is a fragmentary perspective interior view of a dismountable building and my novel means for anchoring the same.

FIG. 2 is an enlarged fragmentary detail sectional view taken on line 8—8 of FIG. 1.

FIG. 3 is a fragmentary detail sectional view of the anchor taken on line 9—9 of FIG. 2.

DESCRIPTION OF THE PREFERRED EMBODIMENT

Referring to the drawing which illustrates the preferred embodiment of the invention, the numeral 10 designates a metal building of the type formed from preassembled parts or units of a kit supplied to a purchaser in knockdown form to be assembled and erected by the purchaser at a location of his choice, and readily disassembled for removal and erection at a new location. The building 10 has a plurality of rigid main frame units 12 which are of inverted U-shape when erected and which form the primary supports for the side walls and roof of the building. The members 12 are of a size and shape determined by the height, shape and roof contour of the desired building. The lower ends of the main frame members 12 are secured to base plates 14 as by welding. A plate 16 of smaller size than plate 14 is preferably secured to a marginal portion of each plate 14, as by means of bolts and nuts 18. The plate 16 may include a reduced thickness clamp plate portion 20 spaced below a portion of the base plate 14, as best seen in dotted lines at FIG. 1.

Each end of each main frame member 12 bears upon one of a plurality of perimeter plates 22 extending around the marginal portions of the desired building. Preferably each plate 22 has a marginal flange 24. At spaced points along the length of each perimeter plate 22 are located a plurality of earth penetrating or spike members 26. Each spike 26 preferably includes an upper strike flange 28 which is fixedly secured to a perimeter plate 22 in a suitable manner, as by bolts and nuts 30 or by welding. At spaced intervals along its length, each perimeter plate has openings 32 therein.

Building side walls 34 and roof members (not shown) are suitably detachably anchored to the main frame members 12, as by means of purlins or girts (not shown) secured to the frame members 12 and to which the side walls and roof may be secured. The lower margins of the side walls 34 are preferably anchored to the perimeter plates 22, as best seen in FIG. 2, by a construction including angle members 36 secured to a projecting above the outer margins of the perimeter plates 22 and to the upwardly extending leg of which angle members 36 the side walls 34 of the building may be secured, as by means of bolts and nuts 38. Angle members 36 may be bolted or otherwise secured to perimeter plate 22 by bolts and nuts 40.

The perimeter plates 22 preferably bear upon the marginal portions of a flexible sheet or plastic film 42 resting upon the ground and providing an earth coverage spanning the building. The sheet 42 is preferably supplied as a part of the building kit and is preferably provided with indicia (not shown) to guide placement of the perimeter plates 22 and other parts of the building, such as the main frame 12. Sheet indicia may indicate placement of primary anchoring means to be described. It will be understood that placement of the sheet will occur after any change of earth contour as required to insure that perimeter plates 22 will extend substantially in a common plane throughout the perimeter of the building.

Primary anchoring members 44 of earth penetrating type are positioned at spaced intervals around the perimeter of the building and are secured to the perimeter plates 22. In the form here shown, each primary anchor member 44 comprises an elongated bar or rod 46 preferably pointed at one end 48 and screw threaded at 50 at its opposite end. An abutment member 52 is carried by each bar 46 at its screw threaded end, as by being screw threaded thereon. Each bar or rod 46 has secured for a part of the length thereof, preferably adjacent the pointed end 48, a helical or spiral auger flight 54, the same being welded or otherwise fixed on the bar 46.

The threaded upper end of each bar or rod 46 extends through an opening 32 in the adjacent perimeter plate 22 and suitable means 56, such as a nut and washer detachably mounted on each rod 44, bears upon the upper surface of the adjacent perimeter plate. Each bar 46 is of suitable length, such as 30 inches or more, to insure firm anchorage in the earth when the bar has been advanced into the earth by rotation and downwardly exerted pressure, as by means of the chuck of a power drill (not shown).

The preferred method of erecting a building of the character described comprises the initial step of spreading sheet 42 at the location in which the building is to be erected, preferably after insuring that the marginal portions thereof at which the perimeter plates are to be located are substantially level. The sheet 42 bears markings indicating the locations at which the primary anchor members 44 are to be positioned, and the anchoring members pierce the sheet at such points and are advanced into the soil by rotation and downward pressure thereon, for which purpose the leading lower edge of the auger flight penetrates the sheet and then enters the earth. Abutment members 52 are preferably advanced into the earth to a position adjacent the bottom surface of the sheet 42. The placement of the members 52 may occur while the members 52 are in position upon the rods 44, or members 52 may be threaded on the rods 44 after placement of the rods 44 in the earth, as by lifting the margin of the sheet 42 clear of the upper end of the member 44 to facilitate threaded advance of the member 52 to the desired position at or adjacent ground level.

After the primary anchor members 44 are installed in the earth with their uppermost threaded ends 50 projecting above the sheet 42 and above ground level, the perimeter plates 22 are positioned upon the margins of the sheet 42 with the openings 32 therein fitting over the upper threaded ends 50 of the primary anchor members 44. The sheet 42 is of a dimension to project outwardly beyond the outer margins of the perimeter plates 22 and its margins are forced into the earth by the downwardly projecting perimeter plate flanges 24, as best seen in FIG. 2, for firm anchorage of the margins of the sheet 42. The placement of the perimeter plates 22 also entails penetration of the sheet 42 by the spikes 26 thereof. The base plates 14 of the main frame members 12 are then positioned on perimeter plates 22 at points indicated by indicia upon the sheets 42 and are anchored to the perimeter members 22 in any suitable manner. Thus, in constructions wherein the main frame members 12 include base plates 14 and clamp plates 16–20, the lower ends of the frame members may be clamped to the perimeter plates 22 by positioning the parts with the outer margins of plates 14 overlying the perimeter plates 22 and the clamp plate portion 20 underlying the perimeter plate. Clamping pressure of the parts 14, 20 upon perimeter plates 22 may be applied by the bolts and nuts 18. Alternatively, it will be understood that clamp plates 20 may be eliminated and the plates 16 may serve as guides bearing against the inner edges of the perimeter plates 22, and bolts and nuts (not shown) may be utilized to anchor detachably each base plate 14 to the underlying perimeter plate 22. After the main frame parts 12 have been properly positioned the angle members 36 may be applied. Angle members 36 preferably overlie and clamp inturned marginal portions 58 of the sheet 42 as best seen in FIG. 2. The building roof and side members may then be mounted upon the building frame.

It will be apparent from the foregoing description that anchorage of the building to the earth is secured by the primary anchor members 44 and supplemented by the spike members 26 of the perimeter plates 22 and by the outer marginal downturned flanges 24 of the perimeter plates. The multiple point anchorage so provided effectively positions the building against displacement by wind or other adverse forces tending to move or displace the building. The various parts of the building kit are adapted for manipulation easily and quickly by the use of hand tools, such as drills with suitable chucks. The building is also characterized by ready disassembly and dismounting, assuming of course, that the roof and side panels are detachably mounted upon the frame member and parts such as the angle members 36 and frame connecting purlins and girts. Thus the building can be erected and dismounted easily and rapidly, with the parts maintaining their respective characters. Upon dismounting of the building the parts of the kit can be taken to a new location and reassembled and reused. Reuse may include use of the base film 52 despite its apertured condition incident to penetration thereof by the primary anchor members 44 and the spike members 26 incident to original erection thereof.

While the preferred embodiment of the invention has been illustrated and described, it will be understood that changes in the construction may be made within the scope of the appended claim without departing from the spirit of the invention.

What I claim is:

1. Means for anchoring a dismountable building having a plurality of spaced main frame members including base plates, comprising a flexible sheet spread upon the ground at a building site, perimeter plates bearing on the sheet at the marginal portions thereof and having a plurality of spaced apertures therein, said plates including downwardly projecting spikes piercing said sheet and the ground spaced from said apertures, a plurality of elongated auger type anchors driven into the ground with their upper ends projecting through said sheet and each extending through an aperture of a perimeter plate, retainers releasably carried by said anchors, and engaging said perimeter plates, and means for releasably securing each frame base plate to a perimeter plate.

2. The construction defined in claim 1, wherein said last named securing means include a clamp carried by each base plate and engaging a perimeter plate.

3. The construction defined in claim 1, wherein each perimeter plate includes a downturned marginal flange spaced from said spikes.

4. The construction defined in claim 1, and means carried by said perimeter plates for clamping the outer margins of said sheet.

5. The method of anchoring a dismountable building having a plurality of spaced main frame members including base plates, consisting of the steps of spreading upon the ground at a building site a sheet bearing indicia for locating perimeter plates and anchor members, driving through said sheet and into the ground at each anchor indicia an elongated auger type elongated anchor to a position extending through and terminating above said sheet, positioning apertured perimeter plates upon said sheet at said plate locating indicia with said apertures receiving the projecting portions of said anchor members, positioning upon and securing to said perimeter plates the base plates of said main frame members, and applying to said anchor members securing means which engage said perimeter plates.

6. The method defined in claim 5 wherein the step of positioning the perimeter plates includes driving through said sheet and into the ground spike members carried by said perimeter plates.

7. The method defined in claim 5 and securing to said perimeter plates structural members clamping marginal portions of said sheet to said perimeter plates.

* * * * *